US007300047B2

(12) United States Patent
Baum et al.

(10) Patent No.: US 7,300,047 B2
(45) Date of Patent: Nov. 27, 2007

(54) MULTI-LAYER SHEET FEEDER

(75) Inventors: Robert A. Baum, Ft. Collins, CO (US); Tang Kee, Singapore (SG); Robert Haas, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 428 days.

(21) Appl. No.: 10/857,328

(22) Filed: May 28, 2004

(65) Prior Publication Data

US 2005/0275152 A1 Dec. 15, 2005

(51) Int. Cl.
*B65H 5/00* (2006.01)

(52) U.S. Cl. ..... 271/8.1; 271/109; 271/121

(58) Field of Classification Search ..... 271/121–125, 271/109, 264; 492/9–11; 152/154.2; 73/146; 347/216; 358/498
See application file for complete search history.

(56) References Cited

U.S. PATENT DOCUMENTS

| | | | | |
|---|---|---|---|---|
| 2,572,276 | A * | 10/1951 | Edgar | 152/7 |
| 4,362,297 | A | 12/1982 | Landa | |
| 4,418,903 | A | 12/1983 | Landa | |
| 4,598,298 | A | 7/1986 | Groenke et al. | |
| D337,126 | S | 7/1993 | Martin | |
| D337,606 | S | 7/1993 | Khovaylo | |
| 5,312,196 | A | 5/1994 | Hock et al. | |
| 5,316,283 | A | 5/1994 | Tyson et al. | |
| 5,320,436 | A | 6/1994 | Hock et al. | |
| 5,326,090 | A | 7/1994 | Hock et al. | |
| D352,055 | S | 11/1994 | Girard | |
| 5,362,038 | A | 11/1994 | Giles et al. | |
| 5,428,437 | A | 6/1995 | Carter et al. | |
| D406,274 | S | 3/1999 | Brown et al. | |
| D413,622 | S | 9/1999 | Brown et al. | |
| 6,055,047 | A * | 4/2000 | Schweizer et al. | 356/237.1 |
| 6,155,557 | A * | 12/2000 | Suzuki | 271/119 |
| D439,274 | S | 3/2001 | Dwyer et al. | |
| D449,066 | S | 10/2001 | Dwyer et al. | |
| 6,382,620 | B1 | 5/2002 | Gaarder et al. | |
| 6,385,431 | B1 | 5/2002 | Arcaro et al. | |
| D460,105 | S | 7/2002 | Leong et al. | |
| D462,381 | S | 9/2002 | Leong et al. | |
| D465,515 | S | 11/2002 | Hwang et al. | |
| D466,923 | S | 12/2002 | Dwyer et al. | |
| D472,266 | S | 3/2003 | Khovaylo et al. | |
| 6,539,199 | B1 * | 3/2003 | Miyata et al. | 399/394 |
| D477,019 | S | 7/2003 | Dwyer et al. | |
| 6,651,973 | B2 | 11/2003 | Gaarder et al. | |
| 6,677,749 | B2 * | 1/2004 | Butikofer et al. | 324/226 |
| 6,703,924 | B2 | 3/2004 | Tecu et al. | |
| 6,904,243 | B2 * | 6/2005 | Smith et al. | 399/26 |
| 7,175,580 | B2 * | 2/2007 | Wolff et al. | 492/9 |
| 7,180,409 | B2 * | 2/2007 | Brey | 340/442 |
| 2001/0024011 | A1 * | 9/2001 | Tamura | 271/10.1 |

FOREIGN PATENT DOCUMENTS

| | | |
|---|---|---|
| FR | 2862295 | 11/2003 |
| JP | 05249818 A * | 9/1993 |

* cited by examiner

*Primary Examiner*—Patrick Mackey
*Assistant Examiner*—Jeremy R. Severson

(57) ABSTRACT

A sheet feed mechanism having a multi-layer structure. The multi-layer structure has a wear layer adapted to contact a sheet during sheet feeding and a replacement indicator layer adjacent the wear layer. The replacement indicator layer is adapted to indicate a wear condition of the multi-layer structure upon wear through the wear layer to the replacement indicator layer.

24 Claims, 4 Drawing Sheets

MULTI-LAYER SHEET FEEDER

BACKGROUND OF THE RELATED ART

Sheet feeder mechanisms, such as automatic document feeders (ADFs), are often incorporated into electronic devices such as copy machines, fax machines, scanners, and other such devices. Certain sheet feeder mechanisms also have a sheet separation mechanism, which is disposed adjacent the sheet feeder mechanism. The sheet separation mechanism separates a stack of sheets during feeding, such that the sheet feeder mechanism can feed the sheets one after another.

The sheet separation mechanism quickly wears out from use. A worn separation mechanism causes higher jam rates, misfeeds, and other functional errors. Unfortunately, a user is generally unaware of the need for a replacement sheet separation mechanism, such that the operational problems continue. This can result in time-consuming service calls, down time of the electronic device, and customer dissatisfaction.

BRIEF DESCRIPTION OF THE DRAWINGS

Advantages of one or more disclosed embodiments may become apparent upon reading the following detailed description and upon reference to the drawings in which.

DETAILED DESCRIPTION

As discussed in detail below with respect to embodiments of the present invention, wear items, such as sheet feeders and sheet separators, provide a user with a notification to replace the wear item. For example, the wear item may have multiple layers of different colors, which provide a visual indication of a wear condition upon wear from one layer to another. Alternatively, the wear item may have conductive and non-conductive layers coupled to circuitry, which circuitry provides an electronic signal of a wear condition to the user upon wear from one layer to another. Although these multi-layer notification mechanisms are applicable to a variety of wear items, the following discussion is directed toward sheet feeders and sheet separators in electronic devices, such as scanners, fax machines, copy machines, printers and so forth. Also, while other aspects of sheet feed mechanisms exist, for ease of illustration, sheet feed rollers and sheet feed separation pads will be used as examples without limitation.

Figure 1:
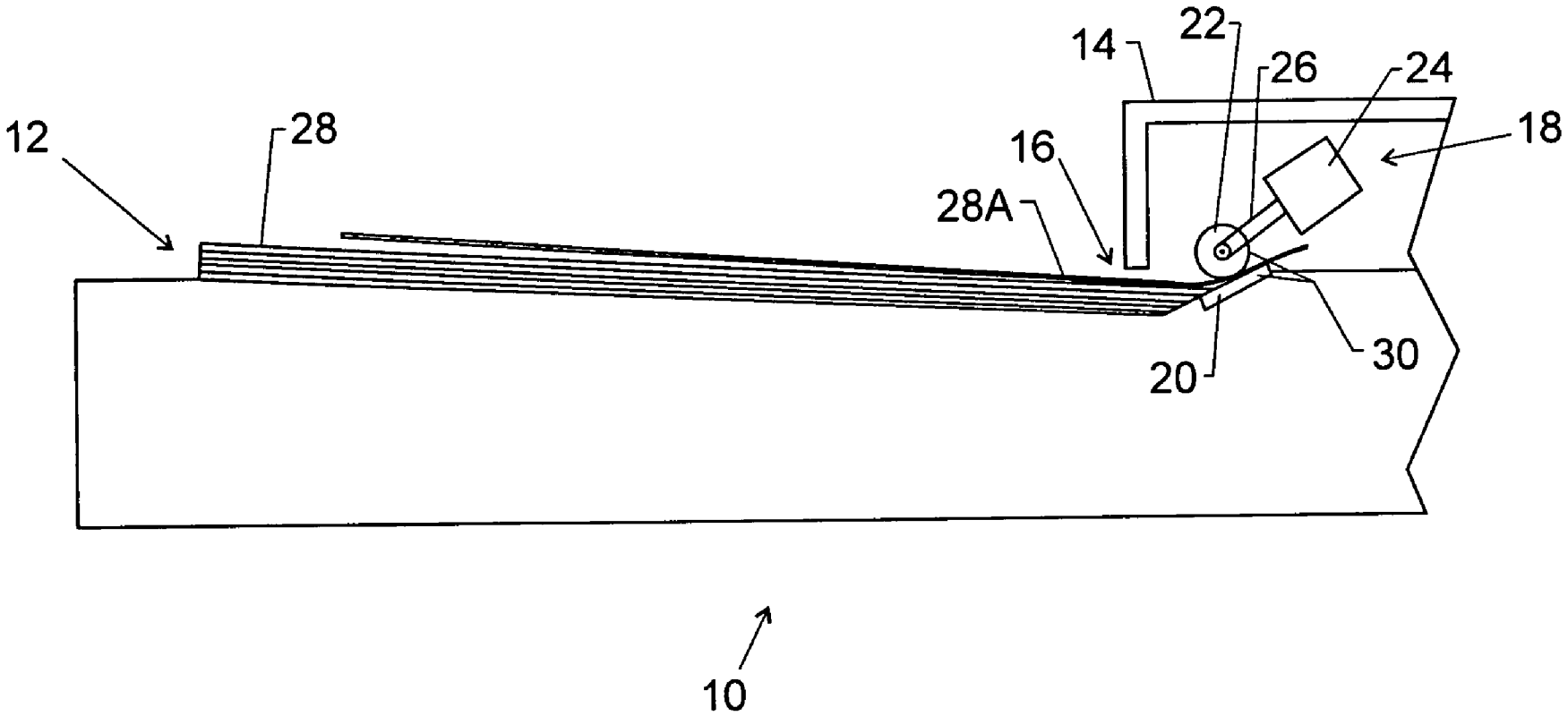
FIG. 1 is a cross-sectional view illustrating a sheet feeder in accordance with embodiments of the present invention.

Turning now to the figures, FIG. 1 is a cross-sectional view illustrating a sheet feeder 10, sometimes referred to herein as a sheet separator, in accordance with embodiments of the present invention. The sheet feeder 10 comprises a sheet launch area 12 and a protective lid 14, which is retractable to provide internal accessibility. The launch area 12 and protective lid 14 meet at a sheet feed port 16 having a feed mechanism 18. In the illustrated embodiment, the feed mechanism 18 has a separation pad 20, a roller 22, a motor 24, and a belt 26. The roller 22 is coupled to the motor 24 by the belt 26, which cooperatively drives the roller 22 during operation of the sheet feeder 10. As discussed below, at least one wear item of the feed mechanism 18 comprises multiple layers of different colors and/or materials to facilitate the identification of a wear condition of the wear item. For example, in one embodiment a plurality of layers are used to indicate specific levels of wear. Specifically, the color of one layer may indicate ordinary use, a second colored layer may indicate that a replacement should be ordered when it is reached, and a third layer may indicate that operation should stop to prevent damage when it is reached. One skilled in the art would recognize that more or less layers may be used and that different indicator criterion may be utilized.

In the illustrated embodiment, the separation pad 20 and roller 22 cooperatively separate individual sheets from a stack and, also, feed the individual sheets through the sheet feeder 10. For example, FIG. 1 illustrates a sheet stack 28, such as a stack of documents, and a single sheet 28A being separated and fed through the sheet feeder 10. Some embodiments may not have both the roller 22 and the separation pad 20. For example, other embodiments have at least one roller 22 that operates without a separation pad to perform the forgoing feeding and separating.

More specifically regarding operation, the representative sheet feeder 10 operates such that a user may place a sheet stack 28, such as a stack of documents, on the sheet launch area 12 of the sheet feeder 10 to begin the sheet feeding process. In the illustrated embodiment, the sheet launch area 12 is sloped downward toward the feed mechanism 18, allowing for a slight bias of the sheet stack 28 toward the sheet feed port 16. Additionally, a user may simply push one end of the sheet stack 28 within the sheet feed port 16. Accordingly, in operation, one end of the sheet stack 28 is adjacent the feed mechanism 18.

The feed mechanism 18 functions to draw sheets from the sheet stack 28 through the sheet feeder 10, one at a time. In operation, the motorized roller 22 contacts and draws the sheet 28A into the feed mechanism 18. During this feeding, the separation pad 20 frictionally slides along a bottom side of the sheet 28A to prevent feeding of additional sheets into the feed mechanism 18 from the sheet stack 28. For example, in the illustrated embodiment, the roller 22 contacts at least a portion of the separation pad 20, such that the roller 22 creates a motive force and the separation pad 20 creates a frictional force opposite the motive force. The motorized roller 22 then rotates against the single sheet 28A on the top of the sheet stack 28, such that the motive force draws the sheet 28A through the sheet feeder 10. Unfortunately, the motion of the sheet 28 into the sheet feeder 10 also may draw additional sheets from the sheet stack 28. In the illustrated embodiment, the sheet separation occurs at the interface between the separation pad 20 and the roller 22. As the motorized roller 22 draws the sheet 28A, the separation pad 20 frictionally slides along a bottom side of the sheet 28A, such that the frictional force catches and retains any additional sheets moving with the sheet 28A.

Other embodiments may have one or more rollers 22, in parallel and/or opposing one another, that exert a motive force on the sheet stack 28 to draw sheets from the sheet stack 28 through the feed mechanism 18 one after another. In various embodiments roller 22 and/or separation pad 20 are comprised of rubber, plastic, a material with a raised surface, a material with adhesive deposited thereon, or other high friction materials.

Due to the contact and friction between the separation pad 20, the roller 22, and the sheets 28, the separation pad 20 and roller 22 slowly wear with use of the sheet feeder 10. Therefore, the separation pad 20 and the roller 22 are both wear items. In other words, the forces imposed on the respective surfaces of the separation pad 20 and roller 22 typically cause surface wear and material loss, which eventually leads to functional problems with the feed mechanism 18. These two wear items 20 and 22 are referred to singularly and cumulatively, herein, as separation apparatus 30.

The continued use of worn separation apparatuses 30 can result in malfunction. One example of such malfunction is multifeeding, which occurs when multiple sheets are drawn into the feed mechanism. Another example of malfunction is misfeeding, which is the failure to draw sheets into the feed mechanism. Accordingly, to prevent malfunction, it is desirable to provide a means of informing a user of the need to replace the separation apparatuses 30. Present embodiments utilize multiple layers to assist a user in determining when replacement is necessary.

Figure 2:
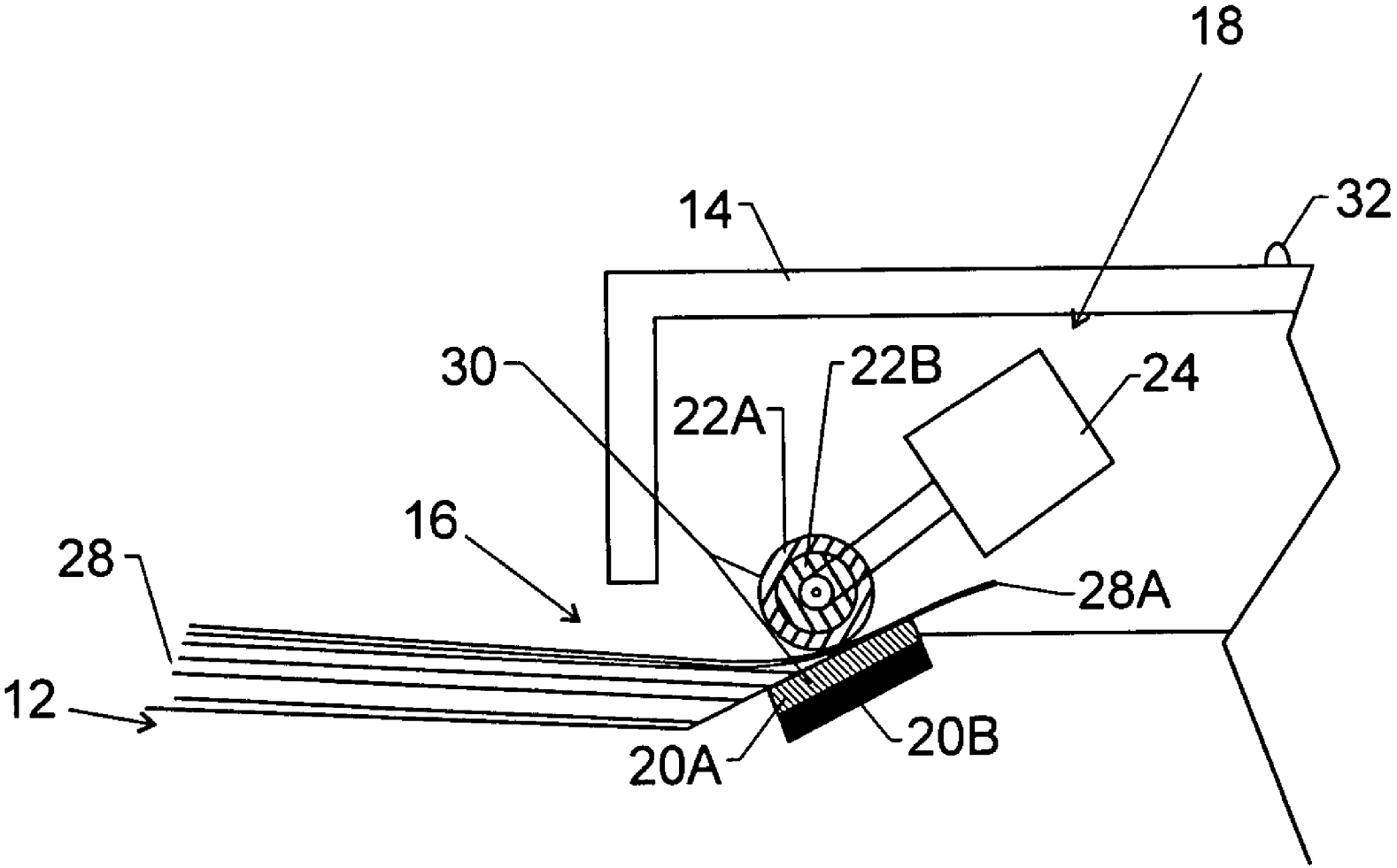
FIG. 2 is a cross-sectional view illustrating a sheet feeder having a multi-layer sheet separator in accordance with embodiments of the present invention.

FIG. 2 is a partial cross-sectional view of the feed mechanism 18 illustrating embodiments of the separation apparatuses 30 in accordance with embodiments of the present invention. As discussed above, the illustrated feed mechanism 18 includes both a separation pad 20 and a roller 22. However, other embodiments may use only a roller 22. Also, embodiments may comprise more than two layers per separation apparatus 30. In the presently illustrated embodiment, the separation pad 20 is shown with two layers, i.e., an outer layer 20A and an inner layer 20B. Similarly, in the illustrated embodiment, the roller 22 comprises an outer layer 22A and an inner layer 22B. This multiple layering 20A, 20B, 22A, 22B provides means for a user to more readily determine the need for replacement of the separation apparatuses 30. For example, in one embodiment, the inner layers 20B and 22B are a different color than the outer layers 20A and 22A. Thus, wearing away of the outer layers 20A and 22A reveals the inner layers 20B and 22B, which visually notifies a user that the particular separation apparatus 30 is in need of replacement.

In other embodiments, outer layers 20A and 22A and inner layers 20B and 22B are composed of different materials. For example, the outer layers 20A and 22A may comprise an electrically conductive material, while the inner layers 20B and 22B comprise a nonconductive material, or vice versa. In one embodiment, a switch, sensor, or other circuitry may be coupled to the separation apparatuses 30, such that wearing through the outer layers 20A and 22A to the inner layers 20B and 22B triggers a switch, generates a signal, and/or changes the state of a circuit (e.g. open to close, or vice versa). Thus, in this embodiment, wearing away of the outer layers 20A and 22A provides electrical indication of the need to replace the separation apparatuses 30. This electrical indication may then trigger a hardware- or software-based indicator, such as an indicator light 32, which functions to inform a user of the pending need to replace at least one of the separation apparatuses 30. The electrical signal or circuit switching also may trigger a message or a display, such as a liquid crystal display (LCD), a remote monitor, a computer screen, and so forth.

Figure 3:
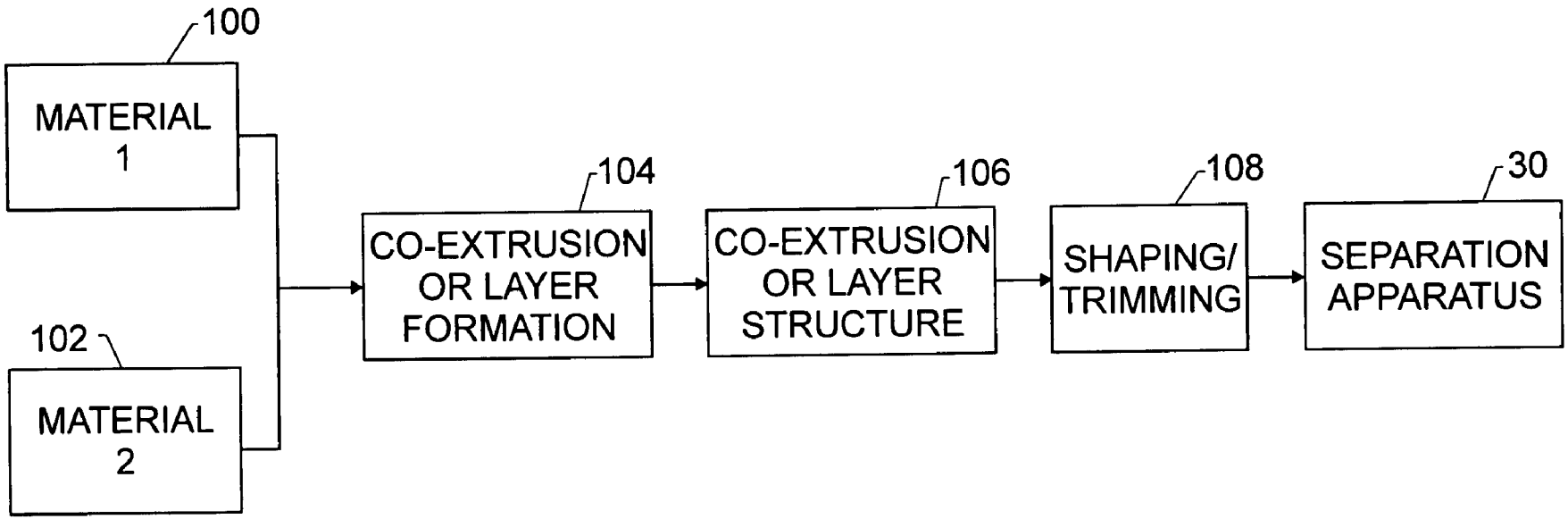
FIG. 3 is a block diagram that illustrates a method of manufacturing a multi-layer sheet separator in accordance with embodiments of the present invention.

The separation apparatuses 30 described above can be manufactured by various different methods, such as molding or extrusion. For example, one manufacturing method, as illustrated in FIG. 3, comprises combining at least two materials 100 and 102 with different colors and/or compositions through a co-extrusion or layering process 104 to produce a co-extruded or layered structure 106. The co-extruded structure 106 is trimmed or shaped into the desired separation apparatus 30 (block 108). For example, a flat embodiment of the co-extruded structure 106 may be cut to form a separation pad 20, whereas a cylindrical embodiment of the co-extruded structure 106 may be cut to form a roller 22. Additionally, other method embodiments may form multiple layers by spraying, gluing, molding, or other layering methods familiar to those skilled in the art.

Figure 4:
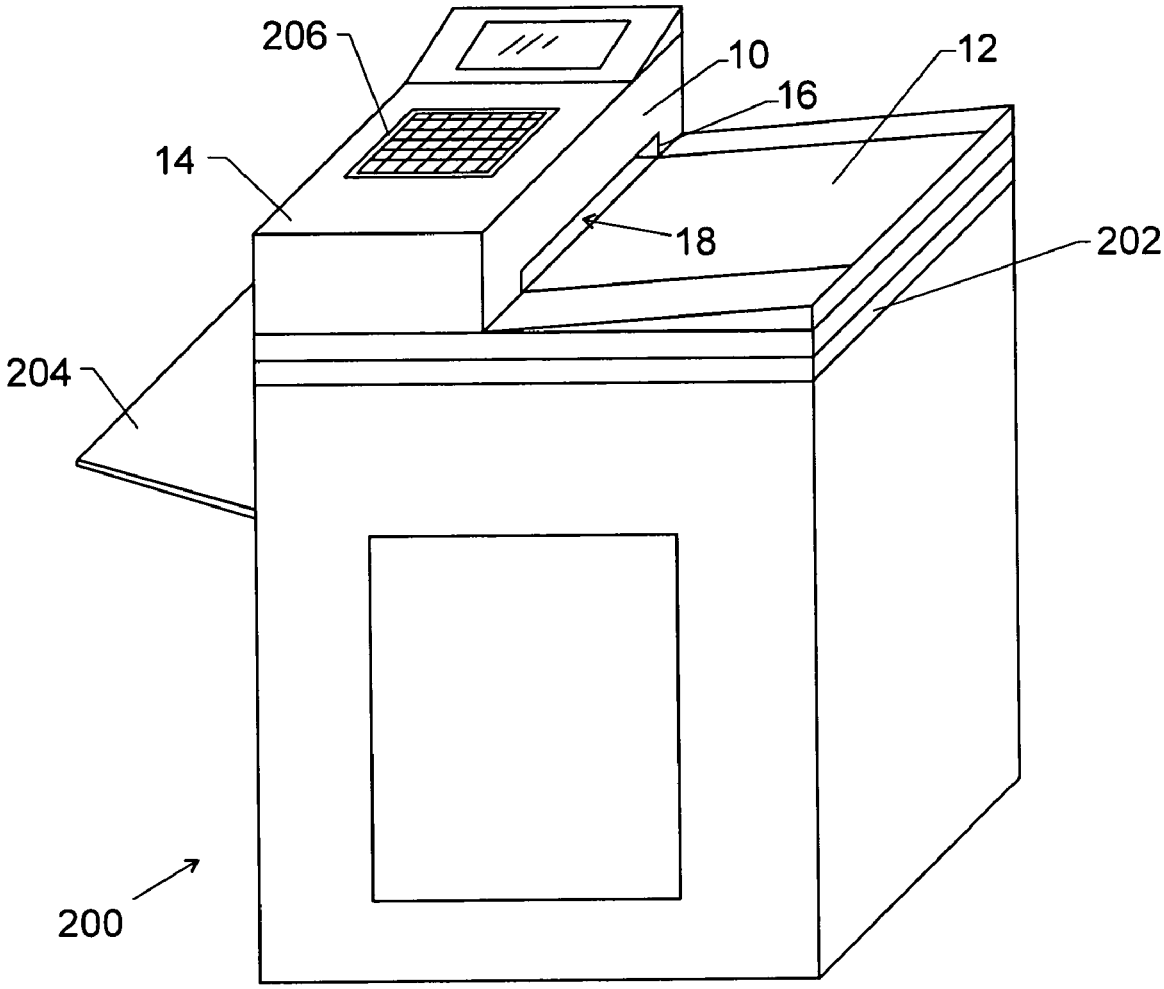
FIG. 4 is a perspective view illustrating a device comprising a sheet feeder with a multi-layer sheet separator in accordance with embodiments of the present invention.

After manufacture, the separation apparatus 30 may be provided separately as replacement parts or as part of a complete package. In fact, in one manufacturing process embodiment, the separation apparatus 30 is inserted into a sheet feeder 10, which is incorporated into a copy machine, a fax machine, a scanner, printer, or another sheet-fed device. FIG. 4 illustrates an exemplary embodiment of a sheet-fed device 200. The illustrated sheet-fed device 200 comprises a flat image producing area 202, a document retrieval tray 204, a control panel 206, and an embodiment of the sheet feeder 10. Accordingly, the sheet-fed device 200 also has the sheet launch area 12, the protective lid 14, the sheet feed port 16, and the feed mechanism 18. Moreover, the sheet-fed device 200 may have one or both of the multi-layered embodiments of the separation pad 20 and the roller 22, as discussed above with reference to FIG. 2.

What is claimed is:

1. A sheet feed mechanism, comprising:

a multi-layer structure, comprising:

a wear layer adapted to contact a sheet during sheet feeding; and a replacement indicator layer adjacent the wear layer and adapted to indicate a wear condition of the multi-layer structure upon wear through the wear layer to the replacement indicator layer, wherein one of the wear layer and the replacement indicator layer comprises an electrically conductive material that is adapted to change a circuit from one state to another upon wear through the wear layer to the replacement indicator layer.

2. The sheet feed mechanism of claim 1, wherein the wear layer comprises a first color and the replacement indicator layer comprises a second color different from the first color.

3. The sheet feed mechanism of claim 1, wherein the other of the wear layer and the replacement indicator layer comprises a non-conductive material.

4. The sheet feed mechanism of claim 1, wherein the multi-layer structure is adapted to create a notification signal upon wear through the wear layer to the replacement indicator layer.

5. The sheet feed mechanism of claim 1, wherein the multi-layer structure comprises a sheet separation pad.

6. The sheet feed mechanism of claim 1, wherein the multi-layer structure comprises a sheet feed roller.

7. The sheet feed mechanism of claim 1, comprising a sheet-feed device comprising an electrical indicator configured to notify a user of the wear condition based on the state of the circuit.

8. A sheet-feed system, comprising:

a sheet feeder mechanism, having at least one separation apparatus comprising a plurality of layers adapted to indicate a wear condition upon wear through one layer to another of the plurality of layers, wherein at least one of the plurality of layers includes an electrically conductive material that is configured to provide an electrical indication of the wear condition when the at least one of the plurality of layers is worn through.

9. The sheet-feed system of claim 8, wherein the sheet feeder mechanism is coupled to a fax machine.

10. The sheet-feed system of claim 8, wherein the sheet feeder mechanism is coupled to a copy machine.

11. The sheet-feed system of claim 8, wherein the sheet feeder mechanism is coupled to a scanner.

12. The sheet-feed system of claim 8, wherein the plurality of layers comprise at least two different colors.

13. The sheet-feed system of claim 8, wherein the plurality of layers comprise a non-conductive layer that is not electrically conductive disposed adjacent the at least one of the plurality of layers that includes the electrically conductive material.

14. The sheet-feed system of claim 8, wherein the sheet feeder mechanism is coupled to a printer.

15. A method, comprising:

providing a multi-layer sheet separator comprising a plurality of layers indicative of a wear condition upon wear through one layer to another of the plurality of layers, wherein at least one of the plurality of layers includes conductive material that is configured to provide an electrical indication when the at least one of the plurality of layers is worn through.

16. The method of claim 15, wherein providing the multi-layer sheet separator comprises forming a multi-layer sheet separation pad.

17. The method of claim 15, wherein providing the multi-layer sheet separator comprises forming a multi-layer roller.

18. The method of claim 15, wherein providing the multi-layer separator comprises co-extruding first and second layers to form the multi-layer sheet separator.

19. The method of claim 15, wherein providing the multi-layer sheet separator comprises forming a first layer and a second layer of a different color than the first layer.

20. The method of claim 15, further comprising providing an automatic sheet feeder having the multi-layer sheet separator.

21. The method of claim 20, further comprising coupling a sheet-feed device to the automatic sheet feeder.

22. A sheet feed system, comprising:

means for feeding at least one sheet; and means for multi-layer indication of a wear condition of the means for feeding, wherein the means for multi-layer indication of the wear condition comprise a layer of conductive material providing an electrical indication of wear upon one of wearing through and wearing to the layer of conductive material.

23. The system of claim 22 wherein the means for feeding comprise means for rolling against an exposed sheet surface of the at least one sheet.

24. The system of claim 22, wherein the means for feeding comprises means for separating the at least one sheet.

* * * * *